US008520876B2

(12) United States Patent
Chang

(10) Patent No.: US 8,520,876 B2
(45) Date of Patent: Aug. 27, 2013

(54) ASSEMBLY STRUCTURE FOR SPEAKER SYSTEM

(76) Inventor: Tzu-Chung Chang, Kaohsiung (TW)

( * ) Notice: Subject to any disclaimer, the term of this patent is extended or adjusted under 35 U.S.C. 154(b) by 288 days.

(21) Appl. No.: 13/048,922

(22) Filed: Mar. 16, 2011

(65) Prior Publication Data

US 2011/0317860 A1 Dec. 29, 2011

Related U.S. Application Data

(63) Continuation-in-part of application No. 12/823,196, filed on Jun. 25, 2010, now abandoned.

(51) Int. Cl.
*H04R 1/02* (2006.01)

(52) U.S. Cl.
USPC ..... 381/332; 381/150; 381/152

(58) Field of Classification Search
USPC ..... 381/332–335, 345, 351, 412, 421, 381/424, 87, 150–152, 116–117; 181/171
See application file for complete search history.

(56) References Cited

U.S. PATENT DOCUMENTS

| | | | | |
|---|---|---|---|---|
| 5,371,805 | A | 12/1994 | Saiki et al. | |
| 7,142,688 | B2 * | 11/2006 | Croft et al. | 381/431 |
| 7,181,041 | B2 * | 2/2007 | Koike | 381/401 |
| 7,278,200 | B2 * | 10/2007 | Steere et al. | 29/594 |
| 7,292,702 | B2 | 11/2007 | Hagman | |
| 7,481,295 | B2 | 1/2009 | Noro et al. | |
| 7,627,134 | B2 * | 12/2009 | Garner et al. | 381/433 |
| 7,864,977 | B2 * | 1/2011 | Sadaie et al. | 381/407 |

* cited by examiner

*Primary Examiner* — Vivian Chin
*Assistant Examiner* — Fatimat O Olaniran
(74) *Attorney, Agent, or Firm* — Alan Kamrath; Kamrath IP Lawfirm, P.A.

(57) ABSTRACT

An assembly structure for a speaker system includes an iron grille, a speaker frame, a plurality of magnets and a plurality of pads. The speaker frame is covered with the iron grille and includes a plurality of through-holes on one face thereof. Each of the through-holes includes a first receiving portion and a second receiving portion. The speaker frame further includes a plurality of magnets each received in the first receiving portion of a respective one of the through-holes. The speaker frame further includes a plurality of pads each received in the second receiving portion of the respective one of the through-holes.

9 Claims, 2 Drawing Sheets

ASSEMBLY STRUCTURE FOR SPEAKER SYSTEM

This is a continuation-in-part application of U.S. patent application Ser. No. 12/823,196 filed on Jun 25, 2010, now abandoned.

BACKGROUND OF THE INVENTION

1. Field of the Invention

The present invention generally relates to an assembly structure of an iron grille and a speaker frame for a speaker system and, more particularly, to an assembly structure of an iron grille and a speaker frame for a wall speaker system or ceiling speaker system.

2. Description of the Related Art

A wall speaker system or a ceiling speaker system generally includes a speaker frame and an iron grille to be attached on the speaker frame. FIG. 1 shows a conventional assembly structure of a speaker frame and an iron grille for a speaker system. The speaker system includes a speaker frame 7, an iron grille 8 and a plurality of magnets 9. The speaker frame 7 includes a plurality of grooves 71 on one face thereof. Each groove 71 includes an inner face. During assembly of the speaker system, a magnet 9 is firstly received in a respective groove 71. The inner face is coated with an adhesive so that the magnets 9 may be better adhered to the speaker frame 7 when received in the grooves 71. After the magnets 9 are disposed in the grooves 71, the speaker frame 7 is covered with the iron grille 8. In the assembly structure shown in FIG. 1, the iron grille 8 is magnetically attracted by the magnets 9 so that the iron grille 8 may be better attached to the speaker frame 7. However, the magnets 9 tend to easily come off the speaker frame 7, resulting in an unstable assembly of the speaker system. To solve the problem, another conventional assembly structure of a speaker frame and an iron grille for a speaker system has been proposed, as shown in FIG. 2. The speaker system includes a speaker frame 7, an iron grille 8 and a plurality of magnets 9. The speaker frame 7 includes a plurality of through-holes 72 on one face thereof. Each through-hole 72 includes two shoulder portions 721. During assembly of the speaker system, a magnet 9 is received in a respective through-hole 72 while abutting with the shoulder portions 721. Each through-hole 72 includes an inner wall coated with an adhesive before receiving one magnet 9, enabling the magnets 9 to be better adhered to the speaker frame 7. In the conventional assembly structure shown in FIG. 2, the iron grille 8 is not magnetically attracted by the magnets 9 in a strong way due to a gap between the magnet 9 and the iron grille 8.

Therefore, it is desired to improve the conventional assembly structure of the speaker frame and the iron grille for the speaker system.

SUMMARY OF THE INVENTION

It is therefore the primary objective of this invention to provide an assembly structure for a speaker system which enables an iron grille to be closely attached on a speaker frame of the speaker system.

It is another objective of this invention to provide an assembly structure for a speaker system which prevents magnets from coming off a speaker frame of the speaker system.

The invention discloses an assembly structure for a speaker system which includes an iron grille, a speaker frame, a plurality of magnets and a plurality of pads. The speaker frame is covered with the iron grille and includes a plurality of through-holes on one face thereof. Each of the through-holes includes a first receiving portion and a second receiving portion. The speaker frame further includes a plurality of magnets each received in the first receiving portion of a respective one of the through-holes. The speaker frame further includes a plurality of pads each received in the second receiving portion of the respective one of the through-holes.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
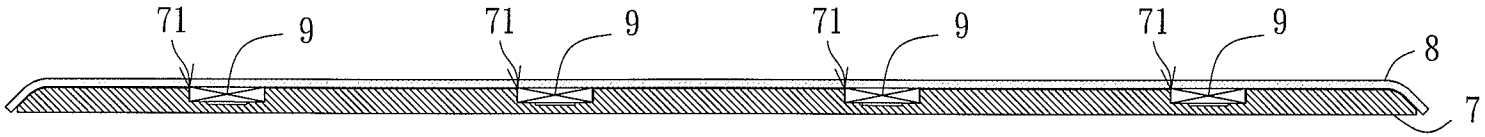
FIG. 1 PRIOR ART
FIG. 1 shows a conventional assembly structure of a speaker frame and an iron grille for a speaker system.
Figure 2:
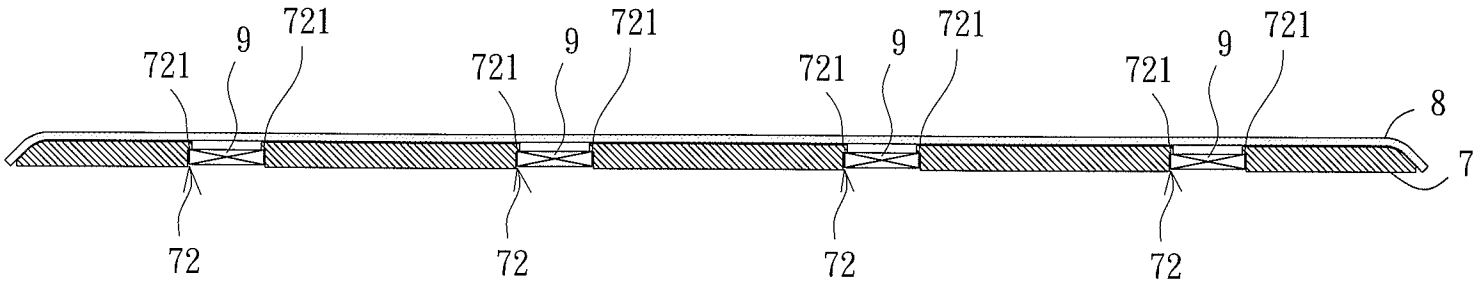
FIG. 2 PRIOR ART
FIG. 2 shows another conventional assembly structure of a speaker frame and an iron grille for a speaker system.

In the various figures of the drawings, the same numerals designate the same or similar parts. Furthermore, when the terms "first", "second", "third", "fourth", "inner", "outer", "top", "bottom" and similar terms are used hereinafter, it should be understood that these terms have reference only to the structure shown in the drawings as it would appear to a person viewing the drawings and are utilized only to facilitate describing the invention.

DETAILED DESCRIPTION OF THE INVENTION

Figure 3:
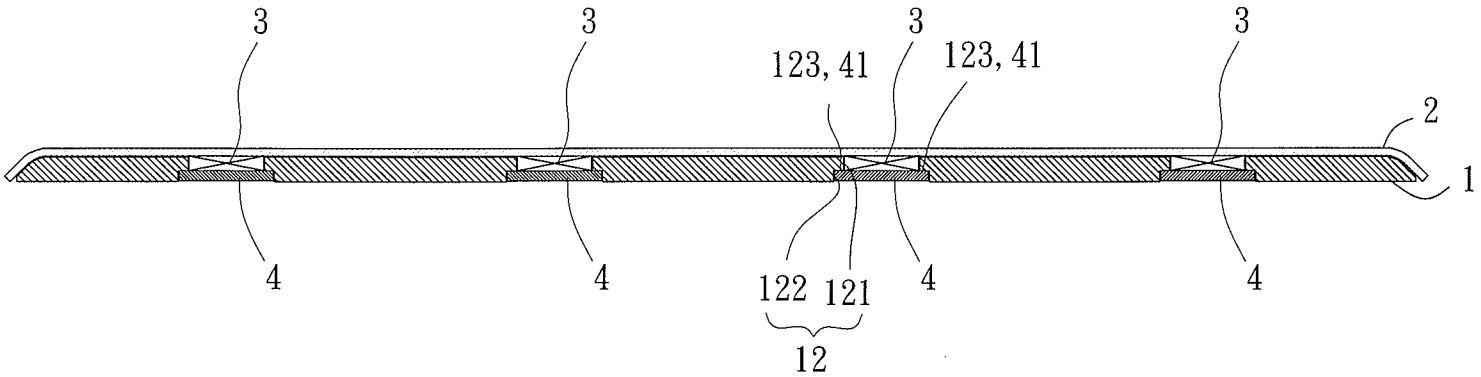
FIG. 3 shows an assembly structure of a speaker frame and an iron grille for a speaker system according to a first embodiment of the invention.

Referring to FIG. 3, an assembly structure of a speaker frame and an iron grille for a speaker system is shown according to a first embodiment of the invention. The speaker system, which may be a wall speaker system or ceiling speaker system, includes a speaker frame 1, an iron grille 2, a plurality of magnets 3 and a plurality of pads 4. The speaker frame 1 includes a plurality of through-holes 12 on one face thereof. Each through-hole 12 includes a first receiving portion 121 and a second receiving portion 122. The second receiving portion 122 includes two shoulder portions 123. The iron grille 2 and the pads 4 may both be made of iron. During assembly of the speaker system, one magnet 3 is received in the first receiving portion 121, and one pad 4 is received in the second receiving portion 122 while an outer edge 41 abuts against the shoulder portions 123. Each first receiving portion 121 includes an inner face coated with an adhesive in order for the magnet 3 to be coupled therewith in a proper manner. The magnets 3 may also be coupled with the first receiving portion 121 by way of clipping instead of using adhesive. The magnet 3 and the pad 4 may be coupled together by way of adhesion or clipping to enhance the coupling therebetween, but are not limited thereto. The speaker frame 1 is covered with the iron grille 2 after the magnets 3 and pads 4 are received in the through-holes 12 of the speaker frame 1. To prevent the magnets 3 from coming off the speaker frame 1, the first receiving portion 121 preferably has a diameter smaller than that of the second receiving portion 122.

Under the structure, the iron grille 2 may be magnetically attracted by the magnets 3 in a proper manner so no gap exists between the magnet 3 and the iron grille 2. In other words, the iron grille 2 is strongly attracted by the magnets 3 so that the iron grille 2 is closely attached on the speaker frame 1. In addition, through the use of the pad 4, the magnets 3 may be prevented from coming off the speaker frame 1. The magnets 3 and the pads 4 may be coupled together by way of adhesion or engagement.

Figure 4:
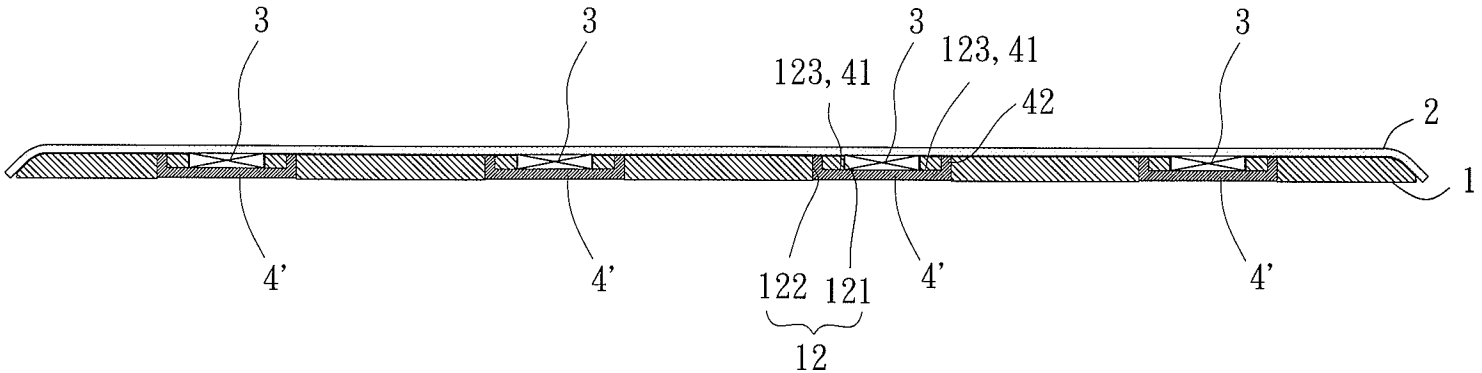
FIG. 4 shows an assembly structure of a speaker frame and an iron grille for a speaker system according to a second embodiment of the invention.

Referring to FIG. 4, an assembly structure of a speaker frame and an iron grille for a speaker system is shown according to a second embodiment of the invention. In comparison with the assembly structure illustrated in the first embodiment, the pad 4 of the first embodiment is replaced by another pad 4' in this embodiment. The pad 4' further includes a plurality of bent portions 42 on the outer edge 41, with the bent portions 42 extending from the outer edge 41 to the iron grille 2. Preferably, the bent portions 42 are formed on an outmost part of the outer edge 41 and reach the iron grille 2. Besides, the magnet 3 is preferably aligned with the center of the pad 4' and between two bent portions 42. Accordingly, the pad 4' with the bent portions 42 can be firmly fixed to the speaker frame 1.

The proposed assembly structures are not only easy to proceed but also can keep the magnet firmly and enhance its magnetizing force.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A assembly structure for a speaker system comprising:

an iron grille;

a speaker frame having a first face covered with the iron grille and including a plurality of through-holes extending from the first face through a second face, wherein each of the plurality of through-holes includes a first receiving portion and a second receiving portion, with the first receiving portion being intermediate the iron grille and the second receiving portion, wherein the first receiving portion has a diameter smaller than a diameter of the second receiving portion, with a shoulder defined between the first and second receiving portions;

a plurality of magnets each received in the first receiving portion of a respective one of the plurality of through-holes and abutting with the iron grille with no gaps; and a plurality of pads each received in the second receiving portion of the respective one of the plurality of through-holes, with the diameter of the first receiving portion being smaller than a diameter of each pad, with the plurality of magnets attaching the iron grille on the speaker frame, with the plurality of pads enhancing a magnetizing force of the plurality of magnets.

2. The assembly structure for the speaker system as claimed in claim 1, wherein the speaker system is a wall speaker system or ceiling speaker system.

3. The assembly structure for the speaker system as claimed in claim 1, wherein the plurality of pads is made of iron.

4. The assembly structure for the speaker system as claimed in claim 1, wherein the first receiving portion includes an inner face coated with an adhesive.

5. The assembly structure for the speaker system as claimed in claim 1, wherein the plurality of magnets and the plurality of pads are coupled with each other by way of adhesion or clipping.

6. The assembly structure for the speaker system as claimed in claim 1, wherein the magnets and the pads are coupled with each other by way of clipping.

7. The assembly structure for the speaker system as claimed in claim 1, wherein a bent portion is formed on an outer edge of each of the plurality of pads and extends into the speaker frame from the outer edge to the iron grille and outwardly of the first receiving portion.

8. The assembly structure for the speaker system as claimed in claim 7, wherein the bent portion is formed at an outmost part of the outer edge.

9. The assembly structure for the speaker system as claimed in claim 7, wherein the bent portion reaches the iron grille.

* * * * *